US009332352B2

(12) United States Patent
Crosby et al.

(10) Patent No.: US 9,332,352 B2
(45) Date of Patent: May 3, 2016

(54) AUDIO SPEAKER WITH SANDWICH-STRUCTURED COMPOSITE DIAPHRAGM

(71) Applicant: Apple Inc., Cupertino, CA (US)

(72) Inventors: Justin D. Crosby, Cupertino, CA (US); Martin E. Johnson, Los Gatos, CA (US); Christopher Wilk, Los Gatos, CA (US)

(73) Assignee: Apple Inc., Cupertino, CA (US)

( * ) Notice: Subject to any disclaimer, the term of this patent is extended or adjusted under 35 U.S.C. 154(b) by 367 days.

(21) Appl. No.: 13/776,597

(22) Filed: Feb. 25, 2013

(65) Prior Publication Data

US 2014/0241567 A1 Aug. 28, 2014

(51) Int. Cl.

| | |
|---|---|
| ***G10K 13/00*** | (2006.01) |
| ***H04R 9/02*** | (2006.01) |
| ***H04R 7/12*** | (2006.01) |
| *H04R 31/00* | (2006.01) |

(52) U.S. Cl.

CPC ..... *H04R 9/025* (2013.01); *H04R 7/122* (2013.01); *H04R 7/125* (2013.01); *G10K 13/00* (2013.01); *H04R 31/003* (2013.01); *H04R 2307/021* (2013.01); *H04R 2307/023* (2013.01); *Y10T 29/49575* (2015.01)

(58) Field of Classification Search

CPC ..... H04R 9/06; H04R 9/025; H04R 7/04; H04R 7/12; H04R 7/16; H04R 7/18; H04R 7/20; H04R 7/24; H04R 7/045; H04R 31/003; H04R 7/125; H04R 7/06; H04R 7/122; H04R 7/127; B01J 35/04; F01N 3/281; F01N 3/2821; F01N 2330/02; B32B 3/12; G10K 13/00

USPC ..... 381/412, 423, 425, 398, 424, 429, 430; 428/593

See application file for complete search history.

(56) References Cited

U.S. PATENT DOCUMENTS

| | | | | |
|---|---|---|---|---|
| 3,328,537 | A * | 6/1967 | Hecht | H04R 7/12 181/169 |
| 4,198,550 | A * | 4/1980 | Matsuda | H04R 7/06 181/167 |
| 4,344,503 | A * | 8/1982 | Nakamura | H04R 7/10 181/168 |
| 4,351,412 | A * | 9/1982 | Yamamuro | G10K 13/00 181/170 |

(Continued)

FOREIGN PATENT DOCUMENTS

| | | |
|---|---|---|
| JP | 58107800 | 6/1983 |
| JP | 59028798 | 2/1984 |

(Continued)

*Primary Examiner* — Davetta W Goins
*Assistant Examiner* — Oyesola C Ojo
(74) *Attorney, Agent, or Firm* — Blakely, Sokoloff, Taylor & Zafman LLP

(57) ABSTRACT

A diaphragm for an audio speaker includes an outer shell and an inner shell. Each shell has a face portion and an edge portion that is formed to be substantially perpendicular to the face portion. The inner shell is inserted into the outer shell such that at least a part of the edge portion of each shell is in contact with at least a part of the edge portion of the other shell and a space is formed between the face portions of each shell. A cellular core fills the space formed between the face portions of each shell and is bonded to the face portion of each shell. The outer and inner shells may have identical sizes and shapes such that there is an interference fit between the contacting edge portions. A voice coil may be supported by the edge portions.

24 Claims, 2 Drawing Sheets

(56) References Cited

U.S. PATENT DOCUMENTS 4,532,383 A * 7/1985 Willy ..... G10K 13/00 181/157
4,817,165 A * 3/1989 Amalaha ..... H04R 7/122 181/170
4,910,065 A * 3/1990 McKinney ..... B29C 67/0044 156/182
5,085,343 A * 2/1992 Scarr ..... B64G 1/402 220/4.14
5,701,359 A 12/1997 Guenther et al.
6,097,829 A * 8/2000 Guenther ..... H04R 7/06 181/169
8,300,875 B2 * 10/2012 Takebe ..... H04R 7/125 381/398
8,300,876 B2 * 10/2012 Xu ..... H04R 1/06 381/150
8,311,264 B2 * 11/2012 Lee ..... H04R 9/022 381/405
8,897,420 B1 * 11/2014 Hunt ..... H01J 35/24 378/125
2002/0146145 A1 * 10/2002 James ..... H04R 9/046 381/426
2004/0146176 A1 * 7/2004 Wu ..... H04R 7/127 381/425
2006/0137935 A1 * 6/2006 Nevill ..... H04R 7/14 181/174
2008/0279415 A1 * 11/2008 Roemer ..... H04R 1/023 381/400
2009/0190794 A1 * 7/2009 French ..... H04R 3/00 381/400

FOREIGN PATENT DOCUMENTS

JP 59034799 2/1984
JP 3122449 6/2006

* cited by examiner

AUDIO SPEAKER WITH SANDWICH-STRUCTURED COMPOSITE DIAPHRAGM

BACKGROUND

1. Field

Embodiments of the invention relate to the field of audio speakers; and more specifically, to the construction of diaphragms for audio speakers.

2. Background

Audio speakers use electrical signals to produce air pressure waves which are perceived as sounds. Many audio speakers use a diaphragm that is movably suspended in a frame. The diaphragm is coupled to a voice coil that is suspended in a magnetic field. The electrical signals representing the sound flow through the voice coil and interact with the magnetic field. This causes the voice coil and the coupled diaphragm to oscillate in response to the electrical signal. The oscillation of the diaphragm produces air pressure waves.

It is desirable for the diaphragm to be stiff so that the diaphragm radiates as a piston as high in frequency as possible. Deformation of the diaphragm affects the efficiency and directivity of the loudspeaker. Diaphragms are generally thin plates and exhibit bending modes within the bandwidth of operation. Making the diaphragm stiff increases the frequency of bending modes. Ideally, the resonant frequency for the first bending mode will be well above the maximum audible frequency.

It is also desirable for the diaphragm to be lightweight. A heavier diaphragm requires more force from the voice coil to move the diaphragm. With a fixed force available, the lightness of the diaphragm is directly proportional to the efficiency of the loudspeaker. A lighter diaphragm reduces the amount of electrical energy that has to be supplied to the voice coil to reproduce a certain pressure. Thus a lighter diaphragm is particularly useful for compact, battery powered devices where it is desirable to minimize power consumption, size, and weight of an audio speaker.

Thus it would be desirable to provide a stiff, lightweight diaphragm for use in audio speakers.

SUMMARY

A diaphragm for an audio speaker includes an outer shell and an inner shell. Each shell has a face portion and an edge portion that is formed to be substantially perpendicular to the face portion. The inner shell is inserted into the outer shell such that at least a part of the edge portion of each shell is in contact with at least a part of the edge portion of the other shell and a space is formed between the face portions of each shell. A cellular core fills the space formed between the face portions of each shell and is bonded to the face portion of each shell. The outer and inner shells may have identical sizes and shapes such that there is an interference fit between the contacting edge portions. A voice coil may be supported by the edge portions.

Other features and advantages of the present invention will be apparent from the accompanying drawings and from the detailed description that follows below.

BRIEF DESCRIPTION OF THE DRAWINGS

The invention may best be understood by referring to the following description and accompanying drawings that are used to illustrate embodiments of the invention by way of example and not limitation. In the drawings, in which like reference numerals indicate similar elements.

DETAILED DESCRIPTION

In the following description, numerous specific details are set forth. However, it is understood that embodiments of the invention may be practiced without these specific details. In other instances, well-known circuits, structures and techniques have not been shown in detail in order not to obscure the understanding of this description. Explanations that duplicate one another may have been omitted.

The meaning of specific terms or words used in the specification and claims should not be limited to the literal or commonly employed sense, but may be different and should be construed in the context of the specification. The terms "first," "second," and the like, herein do not denote any order, quantity, or importance, but rather are used to distinguish one element from another. The terms "a" and "an" herein do not denote a limitation of quantity, but rather denote the presence of at least one of the referenced item.

Figure 1:
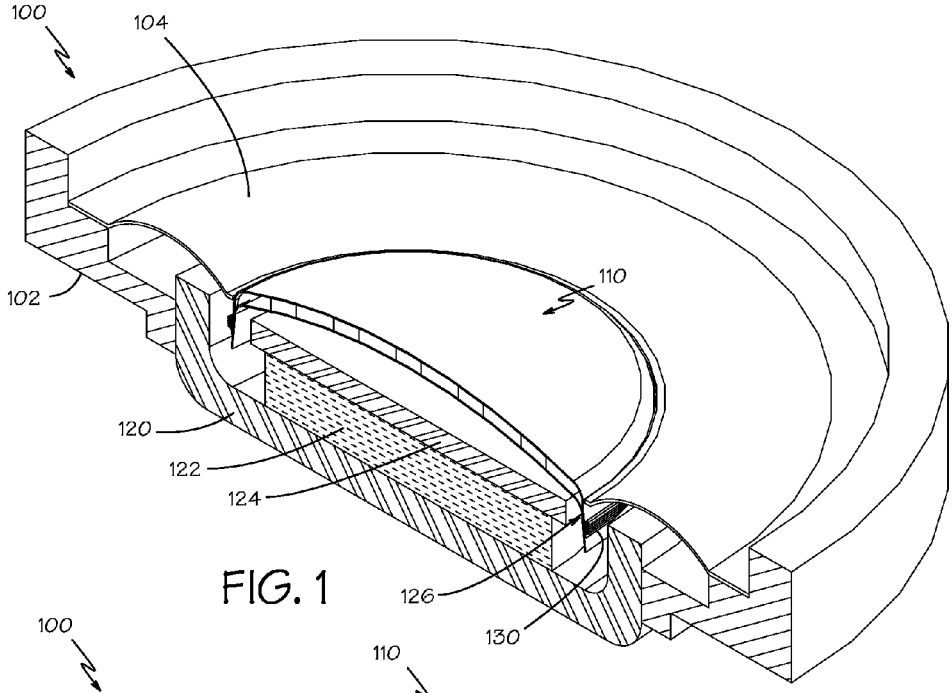
FIG. 1 is a pictorial view of an audio speaker that has been sectioned along a diameter to allow the component parts to be better seen.

FIG. 1 is a pictorial view of an audio speaker 100 that has been sectioned along a diameter to allow the component parts to be better seen.

Figure 2:
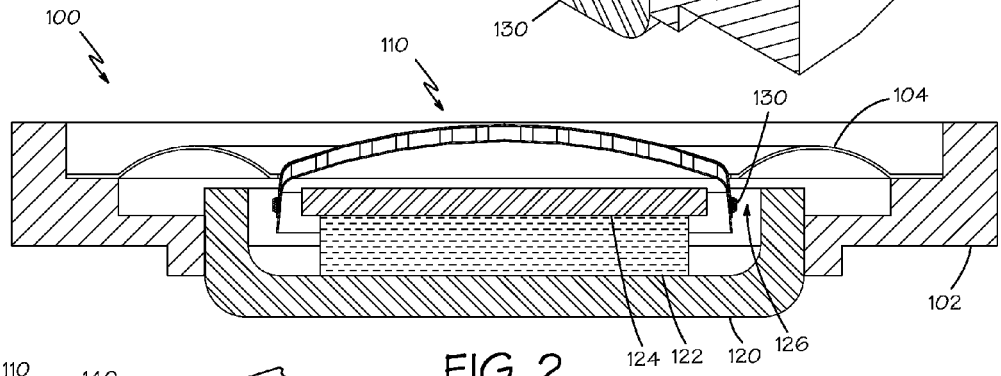
FIG. 2 is a cross-section view of the audio speaker of FIG. 1 taken along the diameter.

FIG. 2 is a cross-section view of the audio speaker 100 of FIG. 1 taken along the diameter.

The audio speaker 100 includes a frame 102. A surround 104 movably connects a diaphragm 110 to the frame 102.

The audio speaker 100 includes a magnetic circuit. The magnetic circuit includes a permanent magnet 122, a pole piece 124, and a magnetic yoke 120. The pole piece 124 and the magnetic yoke 120 are composed of a magnetic material, such as iron. The magnetic circuit provides a magnetic gap 126 across which there is a magnetic flux created by the magnetic circuit.

A voice coil 130 is coupled to the diaphragm 110 such that the voice coil is suspended in the magnetic gap 126. Electrical current flowing through the voice coil 130 interacts with the magnetic flux in the magnet gap 126 to move the voice coil and the coupled diaphragm 110. The moving diaphragm 110 produces air pressure waves which are perceived as sounds by a listener.

Figure 3:
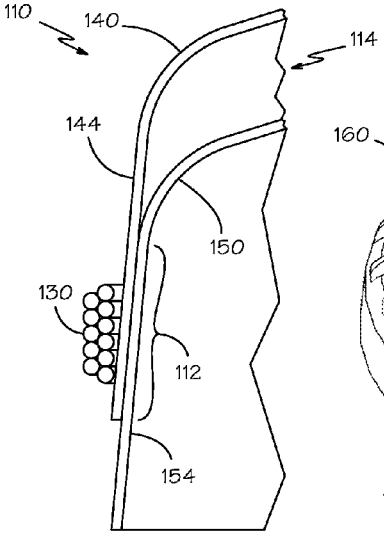
FIG. 3 is an enlarged portion of FIG. 2 showing an edge portion of the diaphragm.

FIG. 3 is an enlarged portion of FIG. 2 showing an edge portion of the diaphragm 110. The diaphragm includes an outer shell 140 and an inner shell 150. Each shell 140, 150 has a face portion 142, 152 and an edge portion 144, 154 that is formed to be substantially perpendicular to the face portion. Substantially perpendicular should be understood to mean as close to perpendicular as possible within the limits imposed by manufacturing processes and the requirements for assembling the diaphragm 110.

The inner shell 150 is inserted into the outer shell 140 such that at least a part of the edge portion 144 of the outer shell 140 is in contact 112 with at least a part of the edge portion 154 of the inner shell 150 and a space 114 is formed between the face portions of each shell.

In one embodiment, the contacting edge portions 112 of the inner shell are adhesively joined to the outer shell. In other embodiments, other methods may be used to join the shells, such as welding, brazing, or soldering as may be appropriate to the materials from which the shells are formed.

In another embodiment, the outer shell 140 and the inner shell 150 have identical sizes and shapes such that there is an interference fit between the contacting edge portions 112 when the inner shell is inserted into the outer shell and the interference fit holds the shells together. The outer shell 140 may be heated to expand the shell and/or the inner shell 150 may be cooled to shrink the shell to facilitate assembly of the parts with an interference fit.

It is desirable that the outer shell 140 and the inner shell 150 be formed of a stiff material. Suitable materials include aluminum, beryllium, titanium, glass fiber composites, carbon fiber composites, and Kevlar®. Preferably, the outer shell 140 and the inner shell 150 are formed from a material having a Young's modulus greater than 10 gigapascals (GPa). The outer shell 140 and the inner shell 150 may have a thickness from about 0.001 inch (0.025 millimeters) to about 0.005 inch (0.125 millimeters).

In the embodiment shown, at least one edge portion 144, 154 of the outer shell 140 and/or the inner shell 150 supports the voice coil 130 within the magnetic field 126. The voice coil 130 may be wound directly on the shells 140, 150 with the edge portions 144, 154 serving as a former for the voice coil. Alternatively, the voice coil 130 may be wound prior to being assembled to the diaphragm 110.

Figure 6:
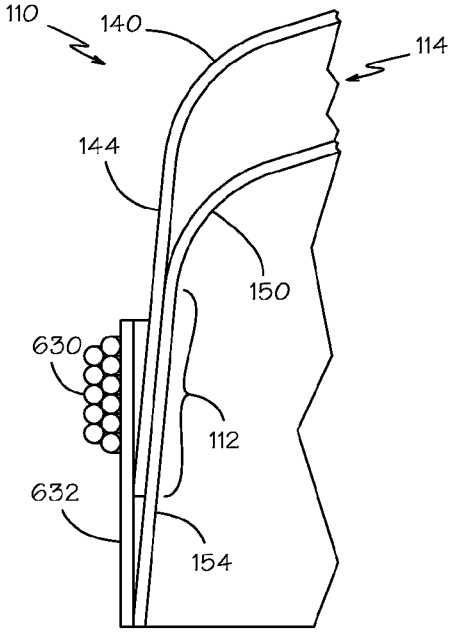
FIG. 6 is an enlarged portion of the edge portion of the diaphragm showing another voice coil.

FIG. 6 is an enlarged portion of the edge portion of the diaphragm 110 showing another voice coil 630. In this embodiment, the voice coil 630 is wound on a separate former 632. The former 632 with the voice coil 630 is assembled to the shells 140, 150. In other embodiments the former 632 may be assembled to the shells 140, 150 before the voice coil 630 is wound onto the former.

The diaphragm includes an outer shell 140 and an inner shell 150. Each shell 140, 150 has a face portion 142, 152 and an edge portion 144, 154 that is formed to be substantially perpendicular to the face portion. Substantially perpendicular should be understood to mean as close to perpendicular as possible within the limits imposed by manufacturing processes and the requirements for assembling the diaphragm 110.

Figure 4:
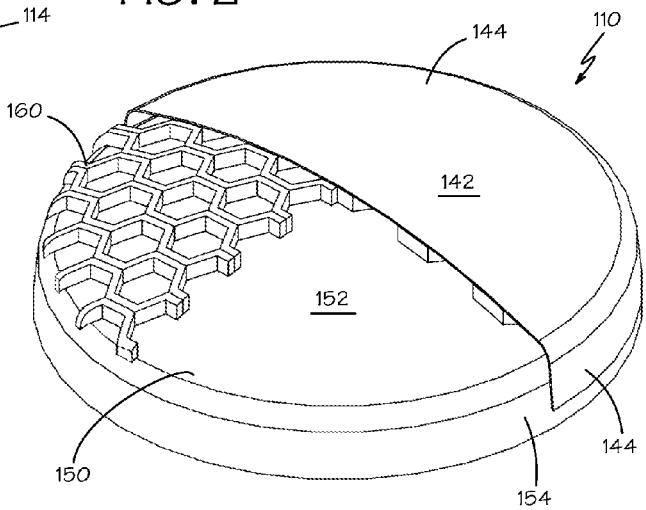
FIG. 4 is a pictorial view of the diaphragm with the outer shell cut away along a diameter and a cellular core with a quadrant cut away to allow the construction of the diaphragm to be seen more clearly.

FIG. 4 is a pictorial view of the diaphragm 110 with the outer shell 140 cut away along a diameter and a cellular core 160 with a quadrant cut away to allow the construction of the diaphragm to be seen more clearly. A cellular core 160 fills the space 114 formed between the face portions 142, 152 of each shell 140, 150. The edges of the cellular core 160 are bonded to the face portions 142, 152 of each shell 140, 150. For example, the cellular core 160 may be a honeycomb structure as illustrated. The structure may be made of cellulose or aluminum, the edges of which are bonded to the face portions with an adhesive. This provides a composite sandwich construction that has a high stiffness to weight ratio.

The nested shell construction is suitable for diaphragms used in miniature speakers where the diaphragm may be 20 to 50 millimeters (mm) in diameter and weigh as little as 0.2 gram. Construction of a composite sandwich of this small size is facilitated by the shape of the outer shell. The substantially perpendicular edge portion 144 of the outer shell 140 holds the cellular core 160 in position during assembly of the diaphragm 110 and bonding of the core to the face portions of the outer and inner shells.

Figure 5:
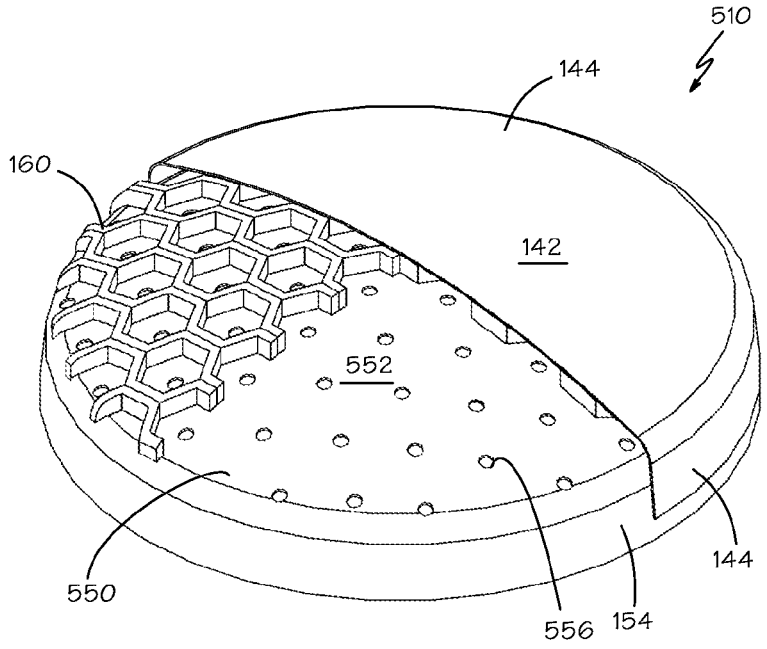
FIG. 5 is a pictorial view of another diaphragm with the outer shell cut away along a diameter and a cellular core with a quadrant cut away to allow the construction of the diaphragm to be seen more clearly.

FIG. 5 is a pictorial view of another diaphragm 510 with the outer shell 140 cut away along a diameter and a cellular core 160 with a quadrant cut away to allow the construction of the diaphragm to be seen more clearly. In this embodiment, the face 552 of the inner shell 550 includes a number of perforations 556 that place the air in each of the cells of the cellular core 160 in communication with air that is external to the diaphragm 510. The permits the air in the cells to achieve equilibrium with the external air. The perforations 556 may be small so that the transient changes in air pressure due to movement of the diaphragm 510 have little effect on the air pressure within the core 160. The purpose of the perforations 556 is to allow the air pressure within the core 160 to adjust to changes in the ambient air pressure such as when there are changes in barometric conditions or when the diaphragm is moved to different altitudes.

In other embodiments (not shown), the walls of the cells of the core may include perforations so that air can flow between cells. This may allow the use of a single perforation, or a small number of perforations, in the shells to place the air in each of the cells of the cellular core in communication with air that is external to the diaphragm.

As previously described. at least one edge portion of the outer shell and the inner shell supports a voice coil within a magnetic field to move the diaphragm when an electrical current flows in the voice coil.

While certain exemplary embodiments have been described and shown in the accompanying drawings, it is to be understood that such embodiments are merely illustrative of and not restrictive on the broad invention, and that this invention is not limited to the specific constructions and arrangements shown and described, since various other modifications may occur to those of ordinary skill in the art. For example, while a round audio speaker has been illustrated, the invention may also be practiced with audio speakers having oval and rectangular shapes. The description is thus to be regarded as illustrative instead of limiting.

What is claimed is:

1. A diaphragm for an audio speaker, the diaphragm comprising:

an outer shell and an inner shell, each shell having a face portion and an edge portion that is formed to be substantially perpendicular to the face portion, the inner shell being inserted into the outer shell such that at least a part of the edge portion of each shell is in contact with at least a part of the edge portion of the other shell and a space is formed between the face portions of each shell, the face portion of the outer shell being solid and the face portion of the inner shell being perforated; and a cellular core that is bonded to the face portions of each shell, the cellular core including a plurality of cells that fill the entire space formed between the face portions of each shell, each of the plurality of cells being filled with air that is in continuous communication with air that is external to the diaphragm through the perforated inner shell.

2. The diaphragm of claim 1 wherein the outer shell and the inner shell have identical sizes and shapes such that there is an interference fit between the contacting edge portions when the inner shell is inserted into the outer shell.

3. The diaphragm of claim 1 further comprising an adhesive that joins the contacting edge portions of the inner shell to the outer shell.

4. The diaphragm of claim 1 wherein the cellular core is honeycomb structure with edges that are adhesively joined to the face portions of each shell.

5. The diaphragm of claim 1 wherein the outer shell and the inner shell are formed from a material having a Young's modulus greater than 10 gigapascals (GPa).

6. The diaphragm of claim 1 wherein at least one edge portion of the outer shell and the inner shell supports a voice coil within a magnetic field to move the diaphragm when an electrical current flows in the voice coil.

7. An audio speaker comprising:

a frame;

a diaphragm that includes an outer shell and an inner shell, each shell having a face portion and an edge portion that is formed to be substantially perpendicular to the face portion, the inner shell being inserted into the outer shell such that at least a part of the edge portion of each shell is in contact with at least a part of the edge portion of the other shell and a space is formed between the face portions of each shell, the face portion of the outer shell being solid and the face portion of the inner shell being perforated, and a cellular core that is bonded to the face portion of each shell, the cellular core including a plurality of cells that fill the entire space formed between the face portions of each shell, each of the plurality of cells being filled with air that is in continuous communication with air that is external to the diaphragm through the perforated inner shell;

a surround that movably couples the diaphragm to the frame;

a magnetic circuit coupled to the frame, the magnetic circuit having a gap and creating a magnetic field within the gap; and a voice coil that is coupled to the diaphragm and passing through the gap of the magnetic circuit to move the diaphragm when an electrical current flows in the voice coil.

8. The audio speaker of claim 7 wherein the outer shell and the inner shell have identical sizes and shapes such that there is an interference fit between the contacting edge portions when the inner shell is inserted into the outer shell.

9. The audio speaker of claim 7 further comprising an adhesive that joins the contacting edge portions of the inner shell to the outer shell.

10. The audio speaker of claim 7 wherein the cellular core is honeycomb structure with edges that are adhesively joined to the face portions of each shell.

11. The audio speaker of claim 7 wherein the inner shell includes a plurality of perforations that place the air in each of the plurality of cells in communication with the air that is external to the diaphragm.

12. The audio speaker of claim 7 wherein the outer shell and the inner shell are formed from a material having a Young's modulus greater than 10 gigapascals (GPa).

13. The audio speaker of claim 7 wherein the voice coil is coupled to at least one edge portion of the outer shell and the inner shell.

14. A method for constructing a diaphragm for an audio speaker, the method comprising:

forming an outer shell and an inner shell, each shell having a face portion and an edge portion that is formed to be substantially perpendicular to the face portion, the face portion of the outer shell being solid and the face portion of the inner shell being perforated;

bonding a cellular core to the face portion of the outer shell;

inserting the inner shell into the outer shell such that at least a part of the edge portion of each shell is in contact with at least a part of the edge portion of the other shell; and bonding the cellular core to the face portion of the inner shell such that the cellular core creates a plurality of cells that fill the entire space formed between the face portions of each shell, each of the plurality of cells being filled with air that is in continuous communication with air that is external to the diaphragm through the perforated inner shell.

15. The method of claim 14 wherein the outer shell and the inner shell have identical sizes and shapes such that there is an interference fit between the contacting edge portions when the inner shell is inserted into the outer shell.

16. The method of claim 14 further comprising joining the inner shell to the outer shell with an adhesive between the contacting edge portions of the inner shell and the outer shell.

17. The method of claim 14 wherein the outer shell and the inner shell are formed from a material having a Young's modulus greater than 10 gigapascals (GPa).

18. The method of claim 14 further comprising coupling a voice coil to at least one edge portion of the outer shell and the inner shell.

19. A diaphragm for an audio speaker, the diaphragm comprising:

an outer shell and an inner shell having identical sizes and shapes, each shell having a face portion and an edge portion that is formed to be substantially perpendicular to the face portion, the face portion of the inner shell being perforated, the inner shell being inserted into the outer shell such that a space is formed between the face portions of each shell and there is an interference fit between at least a part of the edge portions of the outer shell and the inner shell; and a cellular core that is bonded to the face portions of each shell to create a plurality of cells that fill the entire space formed between the face portions of each shell, each of the plurality of cells being filled with air that is in continuous communication with air that is external to the diaphragm through the perforated inner shell.

20. The diaphragm of claim 19 wherein the edge portions of the outer shell and the inner shell are as close to perpendicular as possible within limits imposed by the requirements for assembling the diaphragm with the interference fit between at least a part of the edge portions of the outer shell and the inner shell.

21. The diaphragm of claim 19 wherein the outer shell is at a higher temperature than the inner shell when the inner shell is inserted into the outer shell to create the interference fit between at least a part of the edge portions of the outer shell and the inner shell.

22. A diaphragm for an audio speaker, the diaphragm comprising:

an outer shell and an inner shell, each shell having a face portion and an edge portion that is formed to be substantially perpendicular to the face portion, the inner shell being inserted into the outer shell such that at least a part of the edge portion of each shell is in contact with at least a part of the edge portion of the other shell and a space is formed between the face portions of each shell; and a cellular core that is bonded to the face portions of each shell, the cellular core including a plurality of cells that fill the entire space formed between the face portions of each shell, each of the plurality of cells being filled with air that is in continuous communication with air that is external to the diaphragm through a respective one of a plurality of holes formed in the face portion of the inner shell.

23. The diaphragm of claim 22 further comprising an adhesive that joins the contacting edge portions of the inner shell to the outer shell.

24. The diaphragm of claim 22 wherein the cellular core is honeycomb structure with edges that are adhesively joined to the face portions of each shell.

* * * * *